US007437091B2

(12) United States Patent
Chae et al.

(10) Patent No.: US 7,437,091 B2
(45) Date of Patent: Oct. 14, 2008

(54) METHOD FOR CONTROLLING TEMPERATURE OF HEAT ROLLER AND IMAGE FORMING APPARATUS BASED ON THE SAME

(75) Inventors: Su-Kyoung Chae, Seoul (KR); Cheol-Ju Yang, Suwon-si (KR); Jun-Bae Jeon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/171,398

(22) Filed: Jul. 1, 2005

(65) Prior Publication Data

US 2006/0013608 A1 Jan. 19, 2006

(30) Foreign Application Priority Data

Jul. 19, 2004 (KR) ..... 10-2004-0056004

(51) Int. Cl.
*G03G 15/20* (2006.01)

(52) U.S. Cl. ..... 399/70

(58) Field of Classification Search ..... 399/69, 399/70

See application file for complete search history.

(56) References Cited

U.S. PATENT DOCUMENTS 5,321,478 A * 6/1994 Nakamura et al. ..... 399/70
5,502,546 A * 3/1996 Muto ..... 399/44
5,682,576 A * 10/1997 Sakai et al. ..... 399/69
6,185,389 B1 2/2001 Bartley et al.
2001/0028807 A1 10/2001 Coleman et al.
2003/0091359 A1* 5/2003 Cho et al. ..... 399/69
2003/0235423 A1 12/2003 Ota
2004/0131375 A1* 7/2004 Lee ..... 399/69
2004/0165903 A1* 8/2004 Lee ..... 399/69

FOREIGN PATENT DOCUMENTS

JP 2001-154533 6/2001
KR 10-215299 8/1996
KR 2000-021894 4/2000

* cited by examiner

*Primary Examiner*—David M Gray
*Assistant Examiner*—Bryan Ready
(74) *Attorney, Agent, or Firm*—Roylance, Abrams, Berdo & Goodman, L.L.P.

(57) ABSTRACT

Disclosed is a method for controlling the temperature of a heat roller and an image forming apparatus based on the same. The image forming apparatus of the present invention includes: a heat roller for heating a printing paper having a toner image formed thereon to completely fuse the toner image to the printing paper; a heat lamp for heating the heat roller; and a controller for controlling the driving of the heat lamp, whereby the heat roller is maintained at a designated target temperature level during a pre-printing period. As such, it becomes possible to prevent a problem with the fusing process caused by low temperature of the heat roller during the pre-printing period for subsequent printing.

8 Claims, 3 Drawing Sheets

METHOD FOR CONTROLLING TEMPERATURE OF HEAT ROLLER AND IMAGE FORMING APPARATUS BASED ON THE SAME

CROSS-REFERENCE TO RELATED APPLICATIONS

This application claims the benefit under 35 U.S.C. § 119 (a) of Korean Patent Application No. 2004-56004, filed on Jul. 19, 2004, the entire disclosure of which is hereby incorporated by reference.

BACKGROUND OF THE INVENTION

1. Field of the Invention

The present invention relates in general to a method for controlling the temperature of a heat roller and an image forming apparatus based on the method. More specifically, the present invention relates to a method for controllably maintaining the temperature of a heat roller for fusing a toner image onto a sheet of printing paper at a certain level, and an image forming apparatus based on the method.

2. Description of the Related Art

An image forming apparatus operates to perform a designated data processing procedure on image data generated by the apparatus itself or inputted from an external device. Then, the image forming apparatus transmits the processed image data externally for printing onto a sheet of printing paper. Examples of image forming apparatuses include copiers, printers, scanners, fax machines, and multifunction apparatuses thereof.

The image forming apparatus exposes image data to a photosensitive object and forms an electrostatic latent image. Toner is applied to the electrostatic latent image using a developer. Thus, a toner image is developed. Consequently, the toner image is then transferred onto a sheet of printing paper. The toner image transferred onto the printing paper is fused by a fusing unit. Then, the image forming apparatus releases the sheet of paper externally, such as to a discharge tray.

The fusing unit of the image forming apparatus includes a press roller for pressing the printing paper after the toner image is transferred. A heat roller then heats the printing paper at a predetermined temperature. To heat the printing paper, the heat roller should be preheated. Otherwise, the toner image formed on the printing paper may not properly fuse onto the printing paper. Consequently, the toner image may become distorted.

To maintain the temperature of the heat roller at a certain level, the image forming apparatus measures the temperature of the heat roller every time a printing job is finished. If the temperature being measured is low, the image forming apparatus drives the heat roller during the pre-printing period to warm up the heat roller prior to printing.

However, in case another print job starts immediately after the previous printing job, the heat roller remains somewhat hot because of the residual heat from the previous printing job. Therefore, driving the heat roller during a pre-printing period is unnecessary. Moreover, a heat lamp is not necessary.

If the heat roller is not warmed during the pre-printing period, heat dissipates during the pre-printing period. In this case, the temperature of the heat roller during the printing job is noticeably decreased. As a result, the toner image formed on the printing paper is not properly fused onto the printing paper.

There have been a number of attempts to prevent the problem with the fusing process. One of them was to drive the heat roller anyway even when the temperature of the heat roller is high, but, this method only resulted in overheating of the heat roller, thus, causing the entire image forming apparatus to malfunction.

Accordingly, there is a need for an improved method of controlling the temperature of a heat roller to prevent image distortion during the fusing process.

SUMMARY OF THE INVENTION

An aspect of the present invention is to solve at least the above problems and/or disadvantages and to provide at least the advantages described below. Accordingly, an aspect of the present invention is to provide a method for controlling temperature of a heat roller and an image forming apparatus based on the same, whereby a problem with the fusing process caused by the temperature drop of the heat roller during the pre-printing period can be prevented.

To achieve the above objects and advantages, there is provided an image forming apparatus. The image forming apparatus includes a heat roller for heating printing paper having a toner image formed thereon to fuse the toner image to the printing paper. Additionally, a heat lamp is provided for heating the heat roller. A controller is provided for controlling the driving of the heat lamp, whereby the heat roller is maintained at a designated target temperature level during a pre-printing period.

Preferably, the image forming apparatus further includes a temperature sensor for measuring the temperature of the heat roller so that if the temperature measurement is higher than the target temperature, the controller controls the driving of the heat lamp. Thus, the temperature of the heat roller during the pre-printing period is maintained at the target temperature level.

Preferably, the controller drives the heat lamp intermittently during the pre-printing period so that the temperature of the heat roller during the pre-printing period is maintained at the target temperature level.

Preferably, the image forming apparatus further includes a power supply for providing power necessary for the heat lamp to heat the heat roller. A switching unit is provided for performing a switching operation to apply the power from the power supply to the heat lamp so that the switching operation is controlled by the controller to ensure that the power from the power supply is intermittently applied to the heat lamp during the pre-printing period.

Another aspect of the present invention provides a method for controlling temperature of a heat roller built in an image forming apparatus. The apparatus includes a heat roller for heating printing paper having a toner image formed thereon to fuse the toner image onto the printing paper. A heat lamp is also provided for heating the heat roller. The method includes the steps of controlling the driving of the heat lamp to maintain the temperature of the heat roller at a target temperature level during a pre-printing period. Thus, if the pre-printing period ends, the heat roller will heat the printing paper.

Preferably, the method for controlling the temperature of the heat roller further includes the step of measuring the temperature of the heat roller. So, if the temperature measurement of the heat roller is higher than the target temperature, the driving of the heat lamp is controlled to maintain the heat lamp at the target temperature level during the pre-printing period.

Preferably, during the pre-printing period the heat roller is driven intermittently in order to maintain the temperature of the heat roller at the target temperature level during the pre-printing period.

Preferably, during the pre-printing period the power is intermittently applied to the heat lamp.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
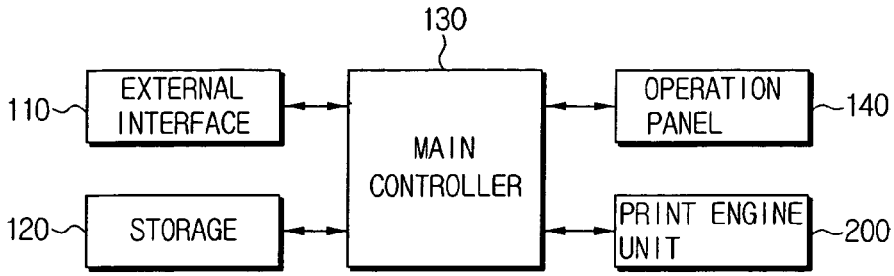
FIG. 1 (PRIOR ART)
FIG. 1 is a schematic block diagram of a conventional image forming apparatus.

FIG. 1 is a schematic block diagram of a conventional image forming apparatus. Referring to FIG. 1, the image forming apparatus includes an external interface 110, a storage unit 120, a main controller 130, an operation panel 140, and a print engine unit 200.

The external interface 110 communicates image data with an external device or over an external communication network. Examples of the external devices include PCs, digital cameras, and mobile storage devices. Examples of the external communication networks include LAN (Local Area Network), Internet, and PSTN (Public Switched Telephone Network). The storage unit 120 is a recording medium that stores data and programs necessary to drive the image forming apparatus. Image data that is received through the external interface 110 is also stored in the storage unit 120.

The operating panel 140 is a user interface including operation keys and a display. A user inputs an operation command by means of the operation keys. The display, such as an LCD (Liquid Crystal Display), displays the operation state and a guidance message. The main controller 130 drives the programs in the storage unit 120. Thus, the main controller 130 controls the overall operation of the image forming apparatus. Particularly, the main control unit 130 issues a print command to the print engine unit 200 to ensure that the image data in the storage unit 120 is printed by the print engine unit 200.

The print engine unit 200, in accordance with the print command from the main controller 130, prints the image data in the storage unit 120 onto printing paper.

Figure 2:
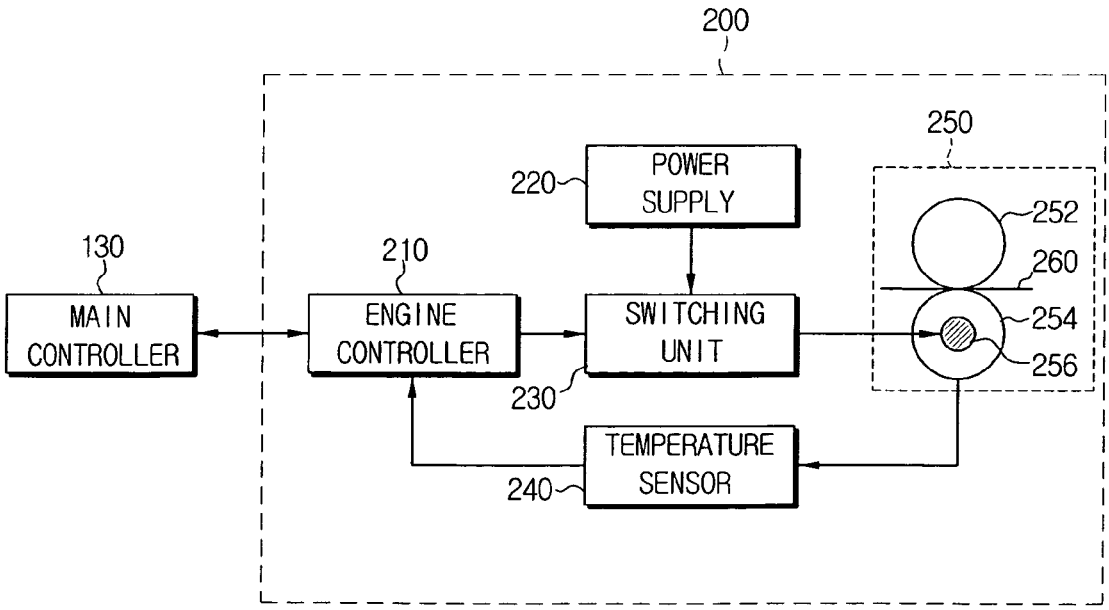
FIG. 2 (PRIOR ART)
FIG. 2 is a detailed schematic block diagram of a print engine unit of the image forming apparatus of FIG. 1.

FIG. 2 is a detailed schematic block diagram of a print engine unit in an image forming apparatus. The main controller 130 is also illustrated in FIG. 2 for explanatory convenience. As shown in the drawing, the print engine unit 200 includes an engine controller 210, a power supply 220, a switching unit 230, a temperature sensor 240, and a fusing unit 250.

The fusing unit 250 completely fuses the toner image onto the printing paper 260. The fusing unit 250 includes a press roller 252, a heat roller 254, and a heat lamp 256.

The press roller 252 applies pressure to the printing paper 260 to ensure that the printing paper 260 closely adheres to the heat roller 254.

The heat roller 254 heats the printing paper 260 to completely fuse the toner image onto the printing paper 260.

The heat lamp 256 is built in the heat roller 254 to heat the heat roller 254. The heat lamp 256 is powered by the power supply 220 to heat the heat roller 254.

The power supply 220 provides the power necessary to operate the print engine unit 200. Particularly, the power supply 220 provides, through the switching means 230, the power necessary for the heat lamp 256 to heat the heat roller 254.

The switching unit 230, which performs the switching under the control of the engine controller 210, applies power provided from the power supply 220 to the heat lamp 256.

The temperature sensor 240 measures the temperature of the heat roller 254. Then, the temperature sensor 240 sends the temperature measurement to the engine controller 210.

The engine controller 210 drives/controls the print engine unit 200 under the control of the main controller 130. Particularly, if the print command is issued from the main controller 130, the engine controller 210 drives the print engine unit 200 to print the image data onto the printing paper 260. In addition, the engine controller 210 controls the driving of the heat lamp 256 to ensure that the heat roller 254 is maintained at a certain temperature level during the pre-printing period.

Figure 3:
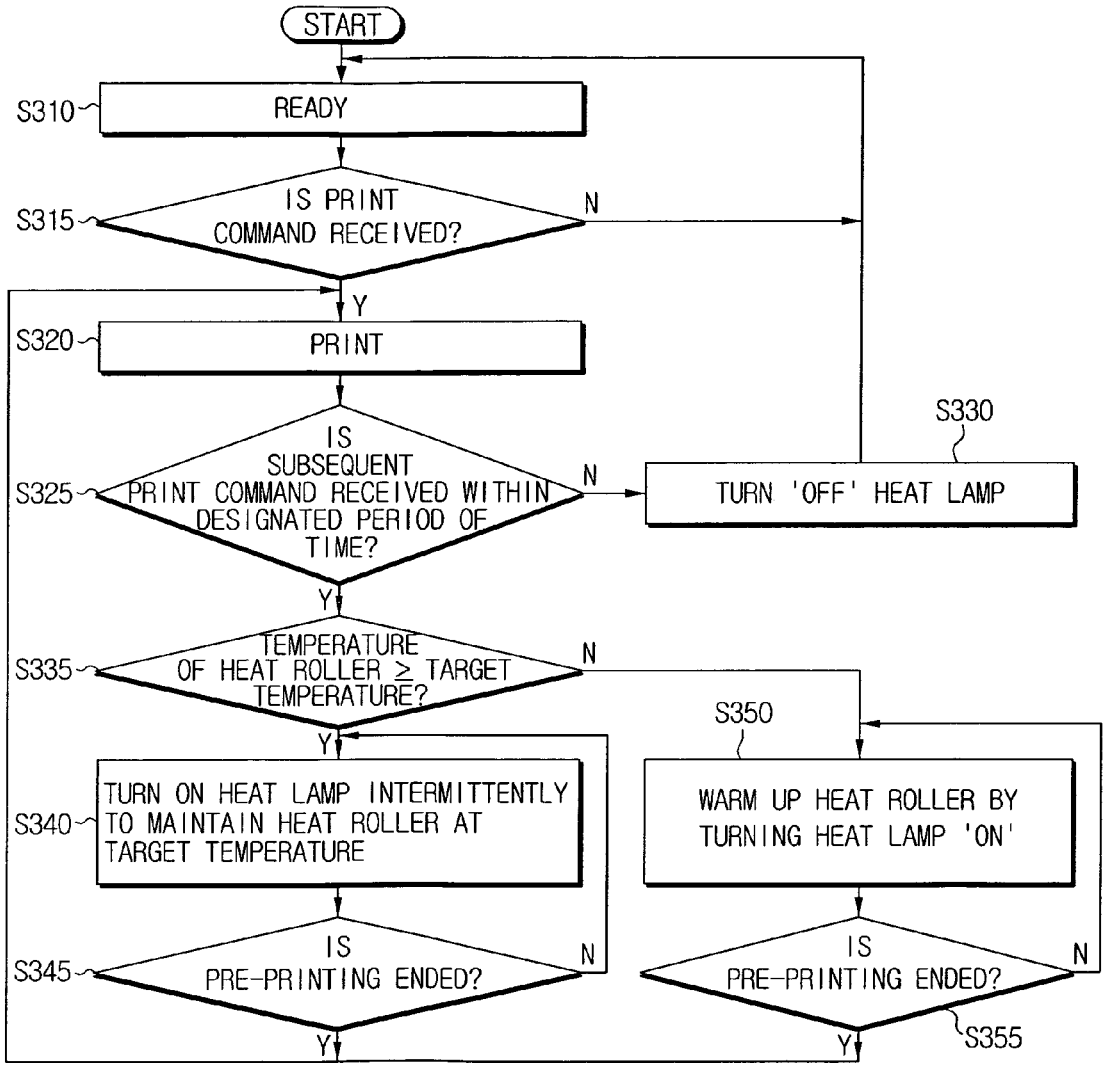
FIG. 3 is a flow chart describing a method for controlling the temperature of a heat roller during the pre-printing period in accordance with an embodiment of the present invention.

The following will now describe in detail how an embodiment of the present invention utilizes the engine controller 210 to control the driving of the heat lamp 256 in order to maintain the temperature of the heat roller 254 at a certain level during the pre-printing period. The description will be based on a flow chart in FIG. 3, which explains a method for controlling the temperature of the heat roller during the pre-printing period.

When the power is supplied or the printing is completed, the print engine unit 200 is in a ready state (S310). In the ready state (S310), the engine controller 210 is able to receive the print command from the main controller 130. If the engine controller 210 does not receive the print command from the main controller 130 (S315), the print engine unit 200 remains in the ready state (S310).

Meanwhile, if the engine controller 210 receives the print command from the main controller 130 (S315), the engine controller 210 drives the print engine unit 200 to print the image data onto the printing paper 260 (S320). If the engine controller 210 does not receive a 'subsequent print command' from the main controller 130 within a designated period of time from the completion of the (first) printing job (S325), the engine controller 210 turns 'OFF' the heat lamp 256 (S330). More specifically, the engine controller 210 controls the switching unit 230 to shut off the power being applied to the heat lamp 256 from the power supply 220, and turns 'OFF' the heat lamp 256. Subsequently, the print engine unit 200 enters the ready state (S310).

On the other hand, if the engine controller 210 receives the 'subsequent print command' from the main controller 130 within the designated lapse of time since the completion of the (first) printing job (S325), the engine controller 210 decides whether the temperature of the heat roller 254 is higher than a 'target temperature' (S335). As aforementioned, the temperature of the heat roller 254 is measured by the temperature sensor 240. The engine controller 210 compares the temperature measurement with the 'target temperature'. Here, the 'target temperature' is a temperature that is warm enough for the toner image formed on the printing paper 260 to properly fuse to the printing paper 260.

If it turns out in step 335 that the temperature of the heat roller 254 is lower than the 'target temperature', the engine controller 210 turns 'ON' the heat lamp 256 for a designated period of time during the pre-printing period to ensure that the heat roller 254 is warmed (S350). More specifically, the engine controller 210 controls the switching unit 230 to apply the power from the power supply 220 to the heat lamp 256, and turns 'ON' the heat lamp 256. When the pre-printing job is completed (S355), the apparatus proceeds with printing (S320).

Figure 4A:
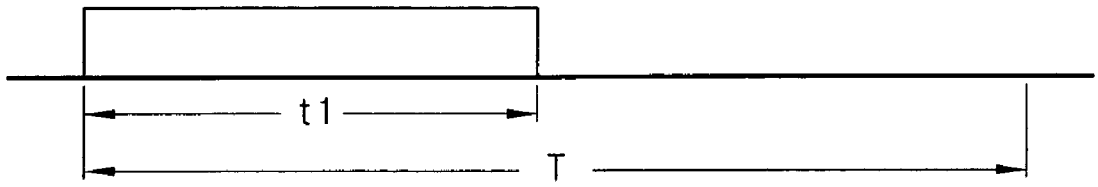
FIG. 4A and FIG. 4B diagrammatically illustrate the relative timings for driving a heat lamp during the pre-printing period.

FIG. 4A illustrates the relative timing for turning 'ON' the heat lamp 256 in step 350. As shown in FIG. 4A, the heat lamp 256 is 'ON' for a first designated period of time t1 during the pre-printing period of time T. By heating the heat roller 254 for t1, the temperature of the heat roller 254 reaches the 'target temperature'.

On the other hand, if it turns out in step 335 that the temperature of the heat roller 254 is higher than the 'target temperature', the engine controller 210 turns 'ON' the heat lamp 256 intermittently during the pre-printing period, to maintain the heat roller 254 at the 'target temperature' level (S340). More particularly, the engine controller 210 controls the switching unit 230 to apply power intermittently from the power supply 220 to the heat lamp 256 (that is, the switching unit 230 is turned 'ON'/'OFF' alternately) and turns 'ON' the heat lamp 256 intermittently. When the pre-printing job is completed (S345), the apparatus proceeds with printing (S320).

Figure 4B:
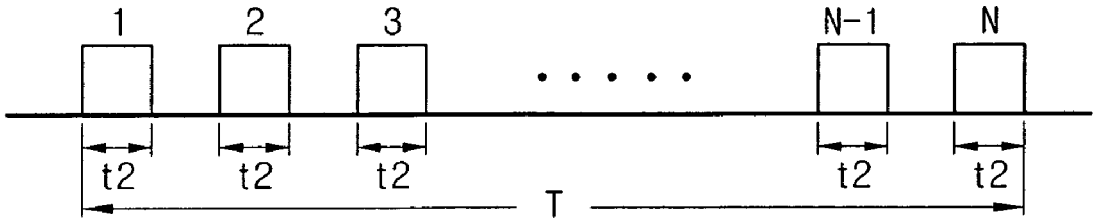

FIG. 4B illustrates the relative timing for turning 'ON' the heat lamp 256 in step 340. As shown in FIG. 4B, the heat lamp 256 is 'ON' for a second designated period of time t2 and for N number of times during the pre-printing period of time T, to maintain its target temperature level.

Relations of $t_1$ (the first designated period of time shown in FIG. 4A), $t_2$ and N can be expressed by the following equation:

$$N=t_1/t_2$$

$$t_2=t_1/N \qquad \text{[Equation 1]}$$

The engine controller 210 can calculate N by using the predetermined t1 and t2, or calculate t2 by using the predetermined t1 and N. Based on t2 and N, the engine controller 210 turns 'ON' the heat lamp 256 intermittently during the pre-printing period of time T as illustrated in FIG. 4B.

Meanwhile, if it turns out in step 335 that the temperature of the heat roller 254 is above a designated critical temperature, the engine controller 210 turns 'OFF' the heat lamp 256 to prevent the heat roller 254 from being overheated.

So far, it has been discussed how to maintain the temperature of the heat roller 254. Specifically, how to maintain the temperature of the heat roller 254 at the 'target temperature' level in cases that the 'subsequent print command' is issued within the designated lapse of time since the completion of the previous printing job or the temperature of the heat roller 254 is higher than the 'target temperature'. The above-described method is applicable to all image forming apparatuses including copiers, printers, scanners, fax machines, and multifunction apparatuses thereof.

In conclusion, in case that the 'subsequent print command' is issued right after the completion of the previous printing job and the temperature of the heat roller is already higher than the 'target temperature', the heat lamp can still be driven intermittently to maintain its temperature. In this manner, it becomes possible to prevent problems associated with the fusing process. More particularly, image degradation caused by the temperature drop of the heat roller during the pre-printing period.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus, comprising:

a heat roller for heating printing paper having a toner image formed thereon to fuse the toner image onto the printing paper;

a heat lamp for heating the heat roller;

a controller for controlling the driving of the heat lamp during a pre-printing period, whereby the heat roller is maintained at a designated target temperature level after a preceding printing is finished and during the pre-printing period, from when a print command for a succeeding printing is received within a predetermined time until the succeeding printing actually starts to be executed; and a temperature sensor for measuring the temperature of the heat roller, wherein when the temperature measurement is higher than the target temperature the controller controls the driving of the heat lamp to be turned on for a predetermined amount of time so that the temperature of the heat roller during the pre-printing period is maintained at the target temperature level.

2. The image forming apparatus according to claim 1, wherein the controller drives the heat lamp intermittently during the pre-printing period so that the temperature of the heat roller during the pre-printing period is maintained at the target temperature level.

3. The image forming apparatus according to claim 1, further comprising:

a power supply for providing power necessary for the heat lamp to heat the heat roller; and a switching unit for performing a switching operation to apply the power from the power supply to the heat lamp, wherein the switching operation is controlled by the controller to ensure that the power from the power supply is intermittently applied to the heat lamp to drive the heat lamp intermittently during the pre-printing period.

4. An image forming apparatus, comprising:

a heat roller for heating printing paper having a toner image formed thereon to fuse the toner image onto the printing paper;

a heat lamp for heating the heat roller;

a power supply for providing power necessary for the heat lamp to heat the heat roller;

a controller for controlling the driving of the heat lamp, whereby the heat roller is maintained at a designated target temperature level after a preceding printing is finished and during a pre-printing period, from when a print command for a succeeding printing is received within a predetermined time until the succeeding printing actually starts to be executed;

a switching unit for performing a switching operation to apply power from the power supply to the heat lamp, wherein the switching operation is controlled by the controller to ensure that power from the power supply is intermittently applied to the heat lamp during the pre-printing period; and a temperature sensor for measuring the temperature of the heat roller, wherein when the temperature measurement is higher than the target temperature the controller controls the driving of the heat lamp to be turned on for a predetermined amount of time so that the temperature of the heat roller during the pre-printing period is maintained at the target temperature level.

5. A method for controlling temperature of a heat roller built in an image forming apparatus which is comprised of a heat roller for heating printing paper having a toner image formed thereon to fuse the toner image onto the printing paper, and a heat lamp for heating the heat roller, the method comprising the steps of:

measuring the temperature of the heat roller, receiving a first print command;

controlling the driving of the heat lamp during a pre-printing period to maintain the temperature of the heat roller at a target temperature level after a preceding printing is finished and during the pre-printing period, from when a print command for a succeeding printing is received within a predetermined time until the succeeding printing actually starts to be executed;

if the pre-printing period ends, heating the printing paper with the heat roller; and a temperature sensor for measuring the temperature of the heat roller, wherein when the temperature measurement is higher than the target temperature the controller controls the driving of the heat lamp to be turned on for a predetermined amount of time so that the temperature of the heat roller during the pre-printing period is maintained at the target temperature level.

6. The method according to claim 5, wherein during the pre-printing period the heat roller is driven intermittently in order to maintain the temperature of the heat roller at the target temperature level during the pre-printing period.

7. The method according to claim 6, wherein during the pre-printing period the power is intermittently applied to the heat lamp to intermittently drive the heat lamp.

8. The image forming apparatus according to claim 2, wherein the controller drives the heat lamp intermittently for a time period t2, wherein t2 is given by the formula:

$$t2=t1/N,$$

where t1 is a first designated period time for which the heat lamp is driven during a pre-printing period, and N is the number of times the heat lamp is driven during the pre-printing period.

* * * * *